US008963666B2

(12) United States Patent
Bilbrey et al.

(10) Patent No.: US 8,963,666 B2
(45) Date of Patent: Feb. 24, 2015

(54) PROGRAMMABLE MAGNETIC CONNECTORS

(75) Inventors: Brett Bilbrey, Sunnyvale, CA (US); Aleksandar Pance, Saratoga, CA (US); Peter Arnold, Cupertino, CA (US); David I. Simon, San Francisco, CA (US); Jean Lee, San Jose, CA (US); Michael D. Hillman, Los Altos, CA (US); Gregory L. Tice, Los Altos, CA (US); Vijay Iyer, Mountain View, CA (US); Bradley Spare, San Jose, CA (US)

(73) Assignee: Apple Inc., Cupertino, CA (US)

( * ) Notice: Subject to any disclaimer, the term of this patent is extended or adjusted under 35 U.S.C. 154(b) by 166 days.

(21) Appl. No.: 13/188,436

(22) Filed: Jul. 21, 2011

(65) Prior Publication Data

US 2012/0021619 A1 Jan. 26, 2012

Related U.S. Application Data

(60) Provisional application No. 61/366,466, filed on Jul. 21, 2010.

(51) Int. Cl.

| | |
|---|---|
| ***H01F 7/20*** | (2006.01) |
| ***H01R 13/62*** | (2006.01) |
| ***H01R 13/641*** | (2006.01) |

(52) U.S. Cl.

CPC ..... *H01R 13/6205* (2013.01); *H01R 13/641* (2013.01)

USPC ..... 335/285; 335/207; 438/38

(58) Field of Classification Search

USPC ..... 335/285–295; 439/38–39

See application file for complete search history.

(56) References Cited

U.S. PATENT DOCUMENTS

| | | | | |
|---|---|---|---|---|
| 5,812,356 | A * | 9/1998 | O'Connor | 361/179 |
| 5,921,783 | A * | 7/1999 | Fritsch et al. | 439/38 |
| 6,561,815 | B1 * | 5/2003 | Schmidt | 439/38 |
| 7,066,785 | B2 | 6/2006 | Park et al. | |
| 7,817,003 | B2 | 10/2010 | Fullerton et al. | |
| 7,834,729 | B2 | 11/2010 | Fullerton et al. | |
| 7,868,721 | B2 | 1/2011 | Fullerton et al. | |
| 8,018,105 | B2 | 9/2011 | Erixon et al. | |
| 8,177,560 | B2 * | 5/2012 | Rohrbach et al. | 439/39 |
| 8,179,219 | B2 | 5/2012 | Fullerton et al. | |
| 8,348,678 | B2 * | 1/2013 | Hardisty et al. | 439/39 |
| 2006/0151990 | A1 | 7/2006 | Cowburn | |
| 2009/0128503 | A1 | 5/2009 | Grant et al. | |
| 2010/0302199 | A1 | 12/2010 | Taylor et al. | |
| 2012/0021619 | A1 | 1/2012 | Bilbrey et al. | |
| 2012/0023597 | A1 | 1/2012 | Bilbrey et al. | |
| 2012/0028480 | A1 | 2/2012 | Bilbrey et al. | |
| 2012/0031153 | A1 | 2/2012 | Conti | |

(Continued)

FOREIGN PATENT DOCUMENTS

| | | |
|---|---|---|
| FR | 2944613 | 10/2010 |
| KR | 20100138219 | 12/2010 |

*Primary Examiner* — Bernard Rojas

(74) *Attorney, Agent, or Firm* — Brownstein Hyatt Farber Schreck, LLP

(57) ABSTRACT

Connectors and methods of coupling electronic devices and cables are provided. In one embodiment, a connector has a first coded magnet on a first surface of a first device. The first coded magnet has at least two different polarity regions on the first surface. A second coded magnet on a second surface of a second device is also provided. The second coded magnet is configured to provide identifying information regarding the device on which it is located.

12 Claims, 17 Drawing Sheets

(56) References Cited

U.S. PATENT DOCUMENTS

2012/0032765 A1 2/2012 Bilbrey et al.
2012/0163754 A1* 6/2012 Benjamin et al. ..... 385/33
2013/0076652 A1 3/2013 Leung

* cited by examiner

PROGRAMMABLE MAGNETIC CONNECTORS

CROSS-REFERENCE TO RELATED APPLICATIONS

This application claims the benefit under 35 U.S.C. §119 (e) to of U.S. Provisional Patent Application No. 61/366,466, filed Jul. 21, 2010 and titled, "Applications of Programmable Magnets," the disclosure of which is hereby incorporated herein by reference in its entirety. This application is also related to U.S. patent application Ser. No. 13/188,428, filed Jul. 21, 2011 and titled "Alignment and Connection for Devices," now U.S. Pat. No. 8,576,034, U.S. patent application Ser. No. 13/188,429, filed Jul. 21, 2011 and titled "Magnetically-Implemented Security Devices," and U.S. patent application Ser. No. 13/188,432, filed Jul. 21, 2011 and titled "Magnetic Fasteners," the disclosures of which are hereby incorporated herein by reference in their entireties.

TECHNICAL FIELD

Embodiments discussed herein relate generally to programmable magnetic devices, and more particularly to multi-part devices that may be joined or separated through programmable magnets.

BACKGROUND

Electronic devices are common in both home and work environments. Indeed, it is common for multiple electronic devices to be located on a single desk, each with one or more cables interconnecting the devices and/or coupling the devices to power. Generally, the connectors used for such couplings include male and female halves with the electronic devices typically having the female half of the connector. Due to current coupler designs, the female half of the connector and the ports of the electronic devices generally preclude sealing of the housings of electronic devices.

Turning to the cables, the male half of the connector usually has pins or prongs that insert into the female receiver of the electronic devices when coupled together but are left exposed when not coupled together. Due to this exposure, the pins or prongs may be damaged and render the connector/cable unusable. Additionally, many connectors are device and/or purpose specific. For example, they may have a certain number of pins or prongs that are configured in a particular manner. As such, each device may have multiple unique cables and connectors that are not compatible with other devices.

SUMMARY

Connectors and methods of coupling electronic devices and cables are provided. In one embodiment, a connector has a first coded magnet on a first surface of a first device. The first coded magnet has at least two different polarity regions on the first surface. A second coded magnet on a second surface of a second device is also provided. The second coded magnet is configured to provide identifying information regarding the device on which it is located.

In another embodiment, a wireless docking system includes a docking station configured to interface with an electronic device and at least one coded magnet on a first surface of the docking station. The first coded magnet has at least two different polarity regions on the first surface. The docking station also includes one or more wireless communication devices positioned on the first surface of the docking station. The docking system additionally includes a docking device having at least one coded magnet located on the docking device in a position that corresponds with the at least one coded magnet of the docking station and at least one wireless communication device configured to communicate with the one or more wireless communication devices.

DETAILED DESCRIPTION

Connectors and methods of coupling electronic devices and cables are provided. In one embodiment a cable is provided having a coupler with dynamic pins. The coupler may have a magnetic code used to identify the connector and the pins may be controlled to extend a distance to provide a desired coupling. Thus, a single connector may be used for multiple different devices.

In some embodiments, the pins may be recessed within the connector so that the connector presents a smooth outer surface. The pins may be extended outwardly magnetically when approaching the port. This may help prevent the pins from being damaged when not coupled. Additionally, in some embodiments, the orientation of the connector may be adjusted to comply with the orientation of its mate. This may allow for a universally adaptable connector.

In one embodiment, a port or other connectors may be completely sealed, thus allowing for a device housing to be hermetically sealed. Correlated magnets may be used to properly orient/position the connectors and communications may be conducted wirelessly (e.g., via light, radio frequency, and so forth).

"Correlated magnets" or "coded magnets" are magnetic structures formed of multiple individual magnetic elements, each of which has both a north and a south pole. The individual magnetic elements may vary in terms of which pole faces a surface of a coded magnet. Thus, a single coded magnet may have multiple magnetic poles on a single surface, and these multiple magnetic poles may cooperate to form a pattern of north and south poles.

Figure 1:
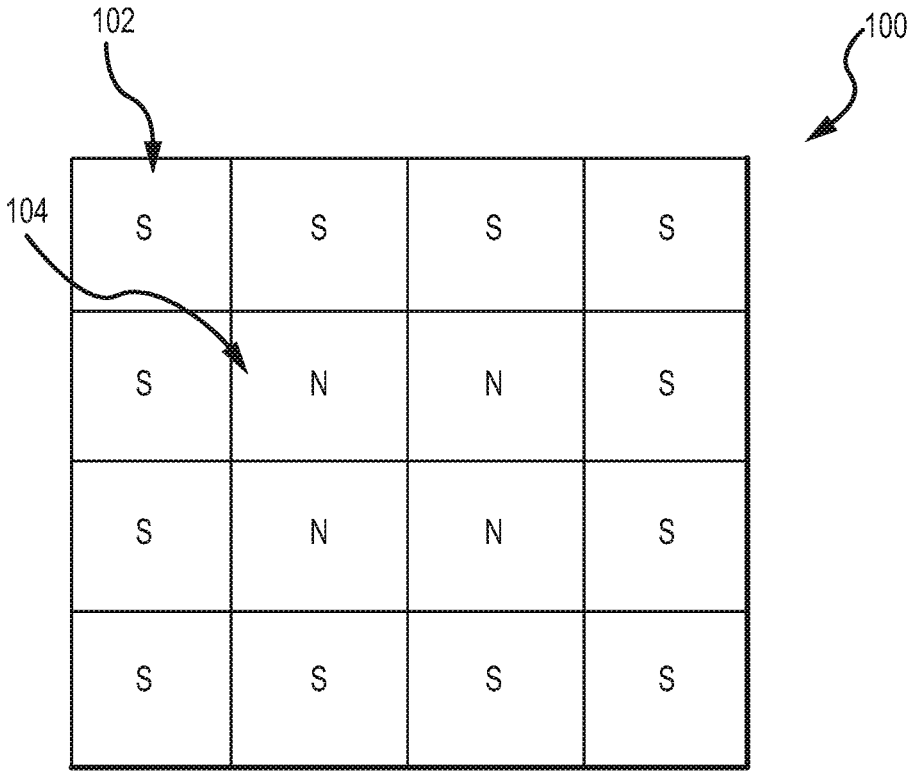
FIG. 1 depicts a coded magnetic structure made from a four-by-four grid of maxels.

FIG. 1 shows an example coded magnet 100 having a four-by-four grid, with each portion of the grid being occupied by a separate magnetic element. The outer portion 102 of the coded magnet 100 may include magnetic elements having their south poles facing in a common direction, such as toward the viewer with respect to FIG. 1. The center two-by-two portion 104 of the coded magnet 100 may contain magnetic elements with their north poles facing toward the viewer with respect to FIG. 1. In this example, the magnetic elements of the coded magnet 100 include 12 magnets presenting their south poles (e.g., negative polarities) toward an exposed surface ringing four magnets presenting their north poles (e.g., positive polarities) toward the same exposed surface. The constituent magnetic elements may be referred to herein as "maxels."

It should be appreciated that the overall magnetic field of the coded magnet 100 will depend on the arrangement of the constituent magnetic elements. Certain correlated magnets may exert a repulsive force at a first distance against an external magnetic or ferrous surface, but an attractive force at a second distance. The exact distances at which a coded magnet may be magnetically attractive or repulsive generally depend on the arrangement and strength of each individual maxel. By properly positioning maxels on a coded magnet surface, a force curve having particular attractive and repulsive strengths at certain distances may be created. It should likewise be noted that the force curve may switch between attraction and repulsion more than once as the separation distance between the coded magnet and magnetic surface increases or decreases.

Generally, the coding of a correlated magnetic surface (e.g., the placement of maxels having particular field strengths and polarities) creates a particular two-dimensional pattern on the surface and thus a three-dimensional magnetic field. The three-dimensional magnetic field may serve to define the aforementioned force curve, presuming that the external magnetic or ferrous surface has a uniform magnetic field.

Further, the two-dimensional pattern of the coded magnetic surface generally has a complement or mirror. This complement is the reversed maxel pattern of the coded magnetic surface. Thus, a complementary coded magnetic surface may be defined and created for any single coded magnetic surface. A coded magnetic surface and its complement are generally attractive across any reasonable distance, although as the separation distance increases the attraction attenuates. With respect to a uniform external magnetic or ferrous surface, the force curve of a complementary coded magnet is the inverse of the original coded magnet's force curve. The force curve between two coded magnets may be varied by misaligning pairs of magnets, magnet strengths and the like, yielding the ability to create highly variable, and thus tailorable, force curves.

Since the maxel pattern of a coded magnet varies in two dimensions, rotational realignment of an external magnetic surface (including a complementary coded magnet) may relatively easily disengage the coded magnet from the external magnetic surface. The exact force required to rotationally disengage two coded magnets, or a coded magnet and a uniformly charged external surface, may be much less than the force required to pull the two apart. This is because rotational misalignment likewise misaligns the maxels, thereby changing the overall magnetic interaction between the two magnets.

Further, it should be appreciated that coded magnets may be programmed or reprogrammed dynamically by using one or more electromagnetic maxels to form the coded surface pattern. As current is applied to the electromagnetic maxels, they will produce a magnetic field. When no voltage is applied, these maxels would be magnetically inert. When the input current is reversed, the polarity of the maxels likewise reverses. Thus, the coding of the coded magnet 100 may be changed through application of electricity. Further, any single electromagnetic maxel yields many possible codings presuming all other maxels remain constant: a first coding for the coded magnetic surface when the electromagnetic maxel is attractive, a second when the current is reversed and the electromagnetic maxel is repulsive, and a third when no current is applied and the electromagnetic maxel is neutral. By varying the position of the maxel on the coded magnet 100 and/or the current supplied to the maxel, even more variations may be obtained. Given a coded magnet having a five-by-five maxel array (for example), the number of possible codings if all maxels are electromagnets, held in a fixed position and supplied with a fixed current is $3^{25}$, or 847,288,609,443 possible codes at any given moment. Since the coding of the surface may be adjusted dynamically, certain embodiments discussed herein may change their magnetic fields on the fly and thus their force curves. Specific implementations of this concept are discussed herein, although those of ordinary skill in the art will appreciate that variations and alternate embodiments will be apparent upon reading this disclosure in its entirety.

Given the foregoing discussion of coded magnets, it should be appreciated that such magnetic surfaces may be incorporated into a variety of devices, apparatuses, applications and so on to create or enhance functionality of one sort or another. Certain embodiments using coded magnets and the function of these embodiments will now be discussed.

Cables

Certain embodiments may take the form of cables incorporating coded magnets. Cables may have coded magnets at one or both ends and/or along one or more portions of the cable body. In the event the coded magnets are situated along the body, they may be laid out in strips, spirals, helixes, geometric shapes and so on. Likewise, coded magnets located at one or both ends of the cable may be arranged in a variety of shapes and patterns. The shapes and/or patterns of the coded magnets on the cable may be chosen to create a specific attractive/repulsive force curve.

As one example, many computers and devices made by Apple Inc. employ MAGSAFE connectors at the ends of cables. The MAGSAFE connector magnetically couples the cable to the appropriate device port in the appropriate position and/or configuration, but will decouple when sufficient force is exerted on the cable or device in order to avoid accidentally jerking or moving the device.

By using a coded magnet for the MAGSAFE connector cord (or in place thereof) and a complementary coded magnet within the device port, the union between the connector and device port may be made more secure. Further, by using a properly coded maxel arrangement for both coded magnets, the device port may actually attract or "suck in" the MAGSAFE connector from a distance. Further, the device port may repel a connector/cord that has a differently-coded coded magnetic surface.

In addition, cables and cords described herein may have coded magnets that permit easy disengagement from a port. The cable's coded magnet may have a force curve that reduces the attractive force significantly, or even creates a repulsive force, when it rotates with respect to a coded magnet within the port. In this manner, the cable may disengage rather than pull an attached device off a table when the cord is sharply tugged or yanked.

Similarly, each port of a device may incorporate a coded magnet having a different maxel pattern. Cords configured to mate with a particular port may have a complementary or attractive maxel pattern, such that the cords may mate with that port but be repulsed by other ports. Further, certain cords may be designed to mate with multiple ports and may have a maxel pattern that, at least at certain distances (such as a relatively close distance), is attracted by the coded magnet of each such port.

Still other embodiments may take the form of a programmable cable. That is, the cable may detect the flux and/or polarity of each individual maxel in a coded magnet of a port, or may detect an overall flux, strength or the like for the coded magnet as a whole.

Figure 2:
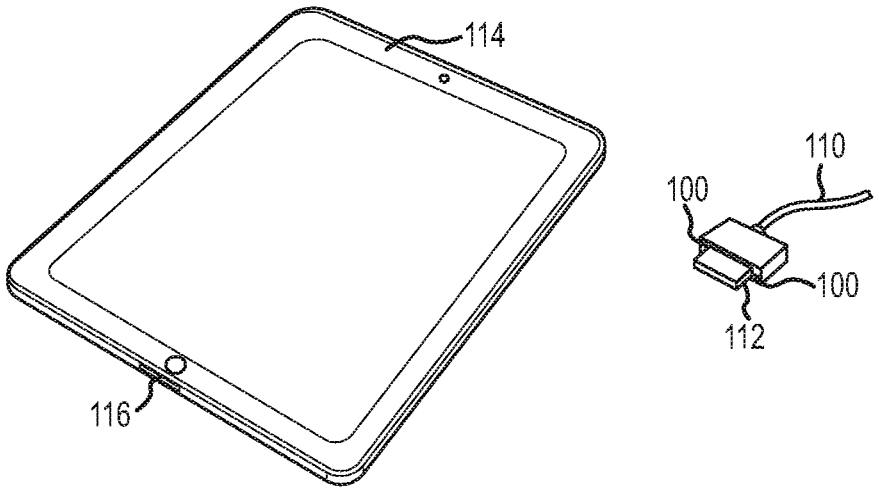
FIG. 2 depicts a cable having a connector with a coded magnetic structure.

In one embodiment, the cable may perform this detection by rapidly switching the maxel patterns of its own coded magnet until they complement the pattern of the port's coded magnet. The cable's coded magnet pattern may be dynamically switched by using electromagnetic maxels, which are capable of switching their polarity as a current is applied. FIG. 2 illustrates a cable 110 having coded magnets 100 and pins 112. The pins 112 may be configured for insertion into a computing device 114 having a port 116 that receives the pins. The coded magnets may be located at the tip of the pin or around the body of the pin.

Figure 3:
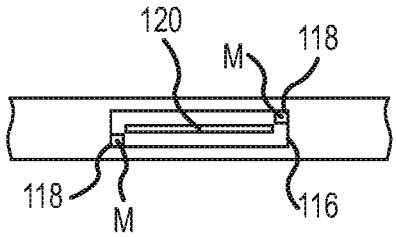
FIG. 3 depicts a port of a computing device having a coded magnetic structure.

The coding of the coded magnets 100 may act as an identifier to the cable 110, indicating the port type and/or type of data transmitted or received by the port 116. FIG. 3 illustrates the port 116 including coded magnets 118 and engagement conductors 120. The engagement conductors 120 are configured to engage the pins 112 of the cable 110 to communicatively couple the computing device 114 with the cable. Upon magnets 100 interacting with the magnets 118 of the port 116, the cable 110 may configure itself accordingly for attachment to the port and/or for appropriate data transfer. The ability to extend, retract, activate or deactivate pins of the cable 110 may provide for backward and forward compatibility. That is, the cable 110 may be dynamically configurable to mate with older version of jacks/ports by extending or retracting additional pins/structure when a force pattern or coded magnet structure is recognized.

Further, the cable 110 may include a control line operative to convey information regarding the port and/or data type to a device connected to the other end of the cord, thereby allowing the two devices to synchronize for transmission. Such an embodiment may further include a current or voltage supply line to each of the maxels in its coded magnet surface (or to a subset of maxels) to permit the electromagnetic maxels to reconfigure their polarity dynamically.

Figure 4:
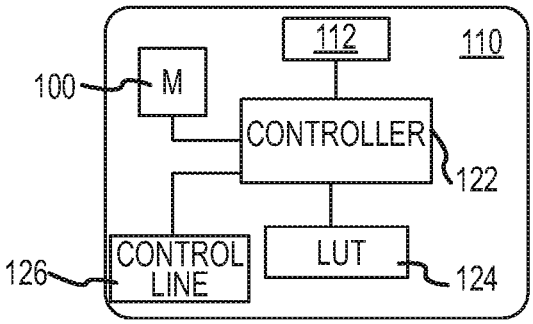
FIG. 4 is a block diagram of the intelligence of the connector of FIG. 2 having a controller in communication with the coded magnetic structure.

FIG. 4 illustrates a block diagram of the intelligence of the cable 110 including a controller 122, a look up table (LUT) 124 and a control line 126. The controller 122 is in communication with the magnets 100, the engagement conductors 120 and the look up table 124. The controller 122 may be configured to read in information from the magnets 118. That is, as the cable 110 approaches the port 116, the magnetic fields of the magnets 100 and 118 interact. The magnets 100 may be configured to align with the magnets 118 and the controller 122 may use the information to identify the port 116. In some embodiments, the controller 122 may reference the LUT 124 to identify the port 116 and its functionality. The LUT 124 may also include instructions for proper coupling with the port 116. For example, the LUT 124 may indicate a depth to which the pins 112 of the cable may extend into the port 116.

Figure 5:
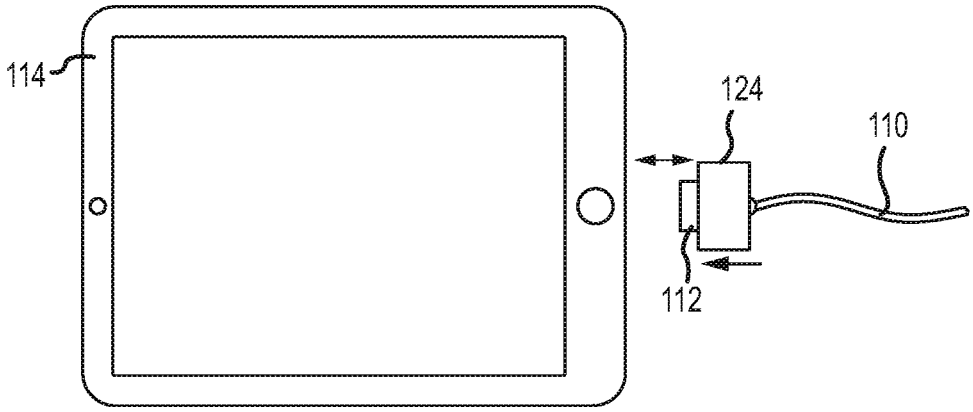
FIG. 5 depicts the coupling of the connector of FIG. 2 with a computing device.

The controller 122 may also adjust the pins 112 accordingly. For example, the pins 112 may be configured to properly interact with the pins 112, such as by repurposing one or more of the pins to correspond with discrete communication channels of the engagement conductors 120 of the port 116. Additionally, in some embodiments, the controller 122 may adjust an exposed length of the pins 112 to match the length of the engagement conductors 120 and/or the depth of the port 116. FIG. 5 illustrates the cable 110 approaching the port 116 of the computing device 114 and the length of the pins 112 being adjusted to fit the port 116. Electromagnetic techniques may be implemented to either lengthen or shorten the pins 112. In some embodiments, the length of the pins 112 may correspond to a particular voltage level of either the cable 110 or the port 116. For example, the length of the pins 112 may be shortened for a 14V channel and lengthened for a 16V channel.

Figure 6A:
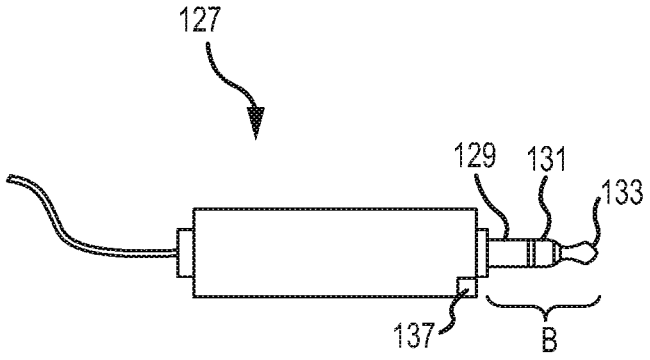
FIG. 6A depicts another connector having a coded magnetic structure.
Figure 6B:
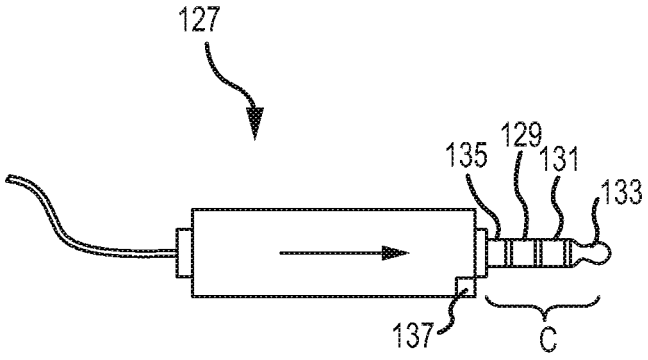
FIG. 6B depicts the connector of FIG. 6A having an extended coupling member.

Another example may include the extension of a connector for additional functionality with a compatible port. FIG. 6A illustrates a connector 127, such as a headphone connector, that has a first length B with three segments 129, 131 and 133. Each segment may provide unique functionality (e.g., ground, and right and left channels for stereo audio). FIG. 6B illustrates the connector 127 having a second length C with four segments 129, 131, 133, and 135. The additional segment 135 may provide additional functionality (e.g., data channel or microphone channel). However, the connector 127 may be configured to only extend to length C when the connector is coupled to a device that provides additional functionality, as may be determined using coded magnets 137 in the connector and the port to which it is to couple. That is, the device that provides additional functionality may be configured with coded magnets that indicate the additional functionality. For example, in some embodiments, it may simply be a single magnet with a particular polarity (e.g., "N") that indicates either the functionality is provided or that the pins should be length C. In other embodiments, the functionality may be communicated via the force curve of coded magnets.

In some embodiments, the type of cable (e.g., functionality), as well as the direction or orientation of a connector may change based on the identity of the port to which it is to couple. That is, for example, a connector having generally horizontally oriented pins may vertically orient them so as to fit a vertical port and vice-versa. Accordingly, if the computer port is in "USB" mode, for example, it has a specific programmable force curve. The cable may start with all north or all south facing magnets and "read" the force curve as it approaches, measuring attraction and repulsion. That may correspond to a particular configuration of the cable's maxels. As another option, the cable may rapidly swap through a variety of configurations, ending when it senses an attraction or mating. As yet another option, the cable may be in wireless communication with the port, so that the computing device can instruct the cable as to what configuration to assume. It should be appreciated that this isn't limited to cables. For example, the present techniques may be implemented with docking stations, flash cards, or any other mating of two electronic devices and/or peripherals.

A similar embodiment may employ the magnets to create a universal port that detects the coded magnet "signature" of a particular cable type and reconfigures itself accordingly. In this embodiment and the foregoing one, the physical connector structure may be a universal one instead of varying by the port and/or cable type.

It should be appreciated that the coded magnets 100 and 118 may be used for repulsion as well as communication, attraction, and alignment. In some embodiments, the magnets may be used to repulse, eject, and/or prevent coupling of certain cables. One practical example may include a heat sensor or other fault sensor coupled to the port 116 to determine if a temperature of the port exceeds an acceptable level. If the level is exceeded, the magnets 118 may be controlled to repel the magnets 100 of the cable 110, thereby ejecting the pins 112 and cable from the port and acting as a failsafe to protect the computing device 114. Further, the magnets may be configured to not receive certain cables based on the patterns/identity presented in the magnets. That is, the magnets may be arranged in a manner that makes it impossible for certain cables to couple with certain ports and vice-versa.

Figure 7:
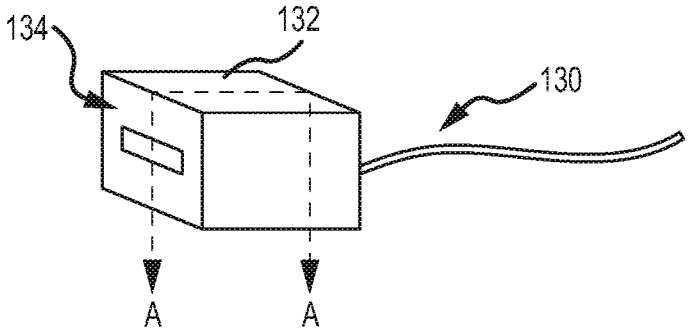
FIG. 7 depicts a connector having a flush surface.

In other embodiments, a connector may have a flush external surface when not coupled. FIG. 7 illustrates a cable 130 having a connector 132 with a flush surface 134 (i.e., nothing extends beyond the connector housing on the coupling side of the connector). That is, pins 136 are retracted into the connector housing 132 so that they are not exposed when the connector is not in use.

Figure 8A:
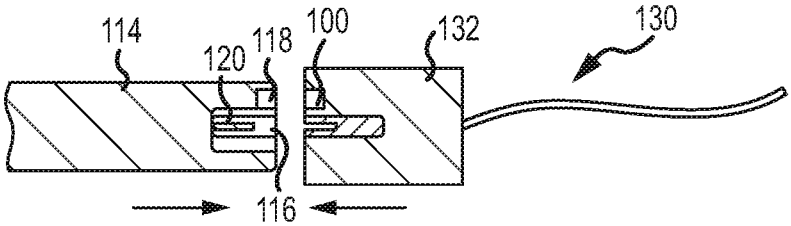
FIG. 8A is a cross-sectional view of the connector of FIG. 7 taken along line AA prior to the connector coupling with a computing device.
Figure 8B:
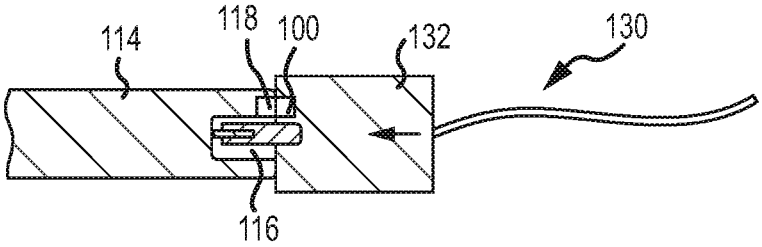
FIG. 8B is a cross-sectional view of the connector of FIG. 7 taken along line AA after the connector is coupled with the computing device.

FIGS. 8A-B are cross-sectional views of the connector 132 taken along line AA in FIG. 7. As may be seen, the pins 136 are retracted within the connector 132 when the connector is not coupled to the computing device 114. However, as shown in FIG. 8B, when the connector is coupled to the computer device 114, the pins 136 move to engage the engagement conductors 120 of the port 116. In this example, the magnets 100 and 118 may provide identity information and secure the connector 132 with the computer device 114. The extension and/or retraction of the pins 136 may be controlled by a controller. In some embodiments, however, the extension or retraction may be achieved through the use of springs. For example, a spring (not shown) may hold the pins 136 in a retracted position until the controller identifies the port 116 via the magnets 100 and provides a force to drive the pins outward from the connector 132. The force to maintain the pins 136 in an extended position may be provided as long as the connector 132 is coupled to the computer device 114, as indicated via the magnets 100. Upon decoupling, the force is removed and the spring may swiftly return the pins 136 to a retracted position, thereby protecting the pins when the connector is not coupled to a device. In other embodiments, the force to retract the pins may be provided by the magnets. That is, instead of a spring pulling the pins back into place, a magnetic force may be used to retract the pins.

Figure 9:
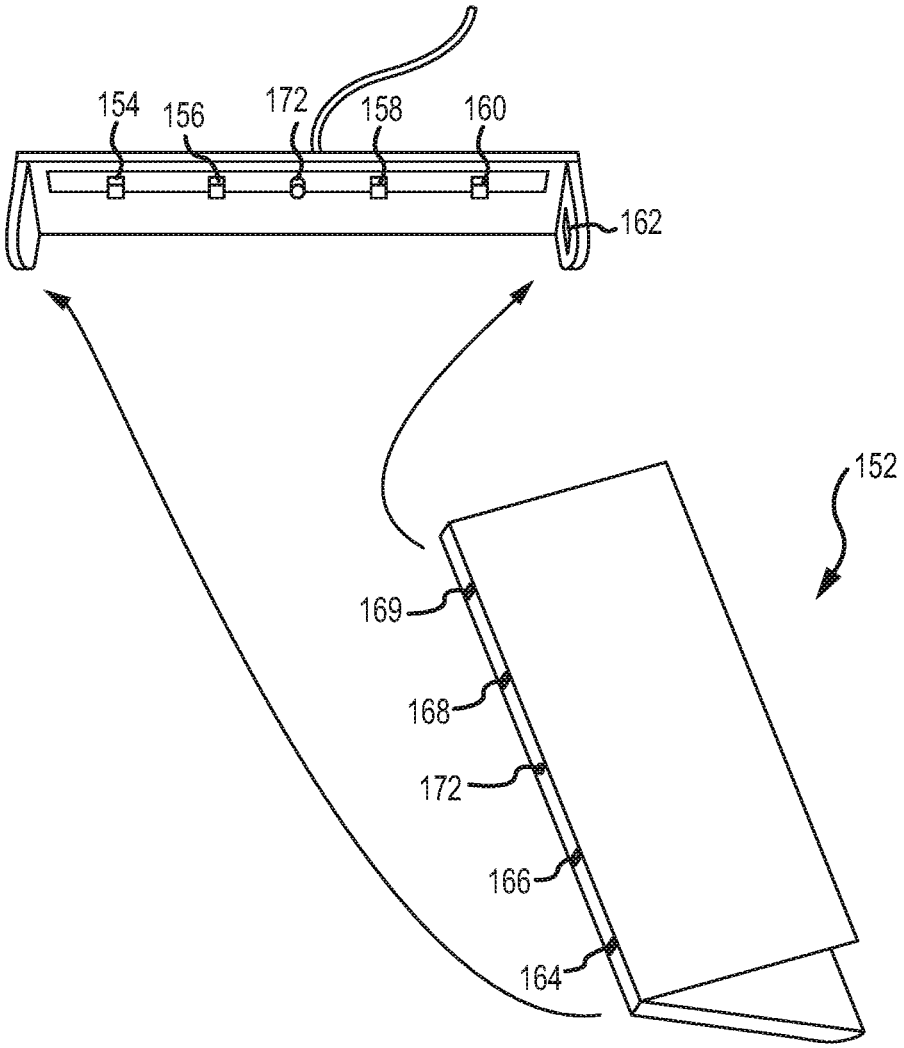
FIG. 9. depicts a docking port for docking of and wirelessly transferring data with a sealed computing device.

In still other embodiments, the coded magnets may help enable a pin-less, hermetically sealed device housing for electronic devices. FIG. 9 illustrates a docking port 150 for a computing device 152. The port 150 and computing device 152 may each be enabled to perform inductive battery charging or other wireless charging, in some embodiments.

The docking port 150 includes multiple coded magnets 154, 162 that may correspond with coded magnets 164 of the computing device 152. The coded magnets 154, 162 may secure the computing device 152 in place, properly orient the device relative to the port 150, and communicate identifying information therebetween in some embodiments. Indeed, in some embodiments, the magnets may be utilized for communications between the port 150 and the device 152.

Additionally, the port 150 may include wireless communication devices 156, 158 and 160. The wireless communication devices 156, 158 and 160 may be configured to wirelessly communicate in accordance with any suitable wireless communication technologies including those for optical communications (e.g., infrared) and radio frequency communications (e.g., Bluetooth, WiFi, etc.).

The computing device 152 may similarly be configured with corresponding communication ports 166, 168, 169 to enable wireless communication and coupling with the port 150. In some embodiments, the port 150 and the device 152 may have correlated extrusions and indentations 172 to help mechanically align and couple the two together. Thus, the computing device 152 may be completely sealed while still allowing for data transfer and battery charging.

Figure 10:
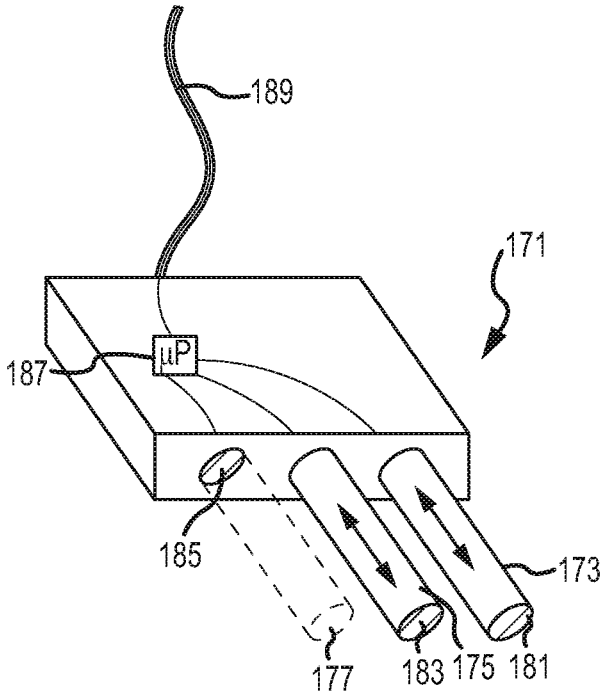
FIG. 10 depicts a dynamic power cord having coded structures to allow the prongs of the cord to extend or retract.

Another example embodiment may take the form of a single power cord that can provide appropriate power levels to multiple devices. That is, the cord can extend pins as necessary to increase the number of conductors providing power. FIG. 10 illustrates a dynamic power cord 171 that is configurable to provide/receive different power levels. The power cord 171 may include multiple prongs that may provide/receive power to/from devices. For example, a first prong 173 may be configured to provide power at a first level (e.g., 5 W), a second prong 175 may provide power at a second level (e.g., 5 W) and a third prong 177 may provide power at a third level (e.g., 2 W). The multiple prongs may be used alone or in combination to achieve various different power levels (e.g., from 2 W to 12 W). As illustrated, the first and second prongs 173, 175 are extended so that the cord 171 may provide/receive 10 W of power. It should be appreciated that more or fewer prongs, pins and/or connector may be provided to achieve a desirable range of power levels. Additionally, the particular power ranges discussed herein are provided only as examples and other power levels may be provided in other embodiments.

As discussed above, coded magnets such as coded magnets 181, 183, 185 may be provided to communicate with devices to which the dynamic power cord 171 is to couple. Further, the coded magnets may be utilized to control the extension/retraction of the prongs. A microprocessor 187 may be provided within the power cord 171 and in communication with the coded magnets to control the operation of the coded magnets. Further, the cord 171 may include a control line 189 so that the microprocessor 187 may communicate with both ends of the cord. It should be appreciated that one or both ends of the cord may include configurable prongs with coded magnets that may be controlled by the microprocessor 187.

The cord 171 may be configured to receive configuration information from a device to which it is to couple. Hence, maxels of the device to which the cord 171 is to couple may cause the prongs to extend or retract. In some embodiments, if the cord 171 is already coupled to the device the microprocessor 187 may communicate a prong configuration to its other end so that the appropriate prongs are extended.

Figure 11:
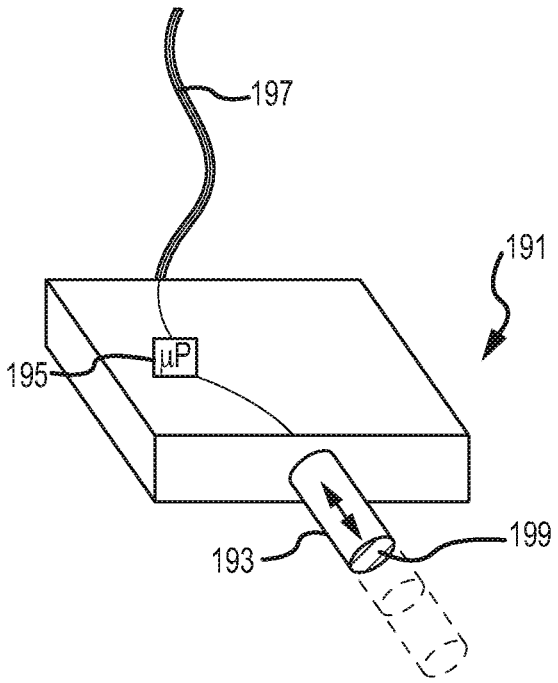
FIG. 11 depicts another dynamic power cord having coded magnetic structures to allow a pin to extend or retract.

FIG. 11 illustrates a power cord 191 having a single pin 193 that is extendable/retractable to provide a particular length for power coupling purposes. The power cord 191 may include a microprocessor 195, control line 197, and coded magnets 199, so that it may be configured according to the demands of the device for which it is supplying power. Generally, as the pin 193 extends it is able to provide increasingly higher power levels to the device.

As another example of an embodiment, certain cords may have coded magnets at, in or proximate one end that permit them to detect an appropriately configured coded magnet in a nearby port of a device. Presuming the force curve is sufficiently attractive, the coded magnet in the cable may "home in" on the coded magnet in the port, physically moving the cable toward the port. In certain cases, the attraction is sufficient to dock or mate the cable to the port. Presuming that each cable is magnetically coded to be so attracted only to the port with which it is designed to interface, a cable may "home in" only on the proper port and ignore the others, thereby ensuring each cable is properly connected to a device.

Figure 12:
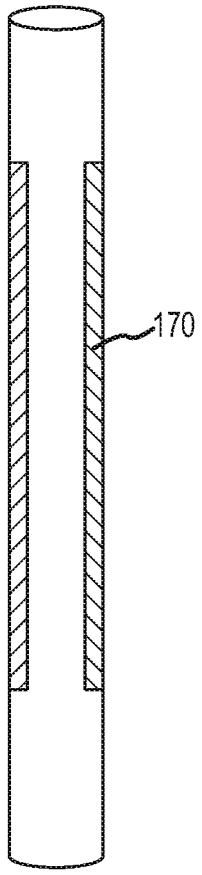
FIG. 12 depicts a cord having coded magnetic structures formed thereon in accordance with an embodiment.

Cables or cords incorporating coded magnetic surfaces may be used to organize, wind, and/or unwind themselves. Consider a group of cords 174 (FIG. 13), each having a coded magnetic surface 170 in a strip, ring, spiral or other pattern about their exterior as shown in FIG. 12. The cables may be provided with a first coded magnetic structure on a first pattern and a second coded magnetic structure on a second pattern. The two coded magnetic structures may attract one another. By placing the patterns appropriately (for example, on opposing sides of a cord or sufficiently near each other that the cord cannot bend to touch the patterns together), attraction of the cord to itself may be avoided.

Figure 13:
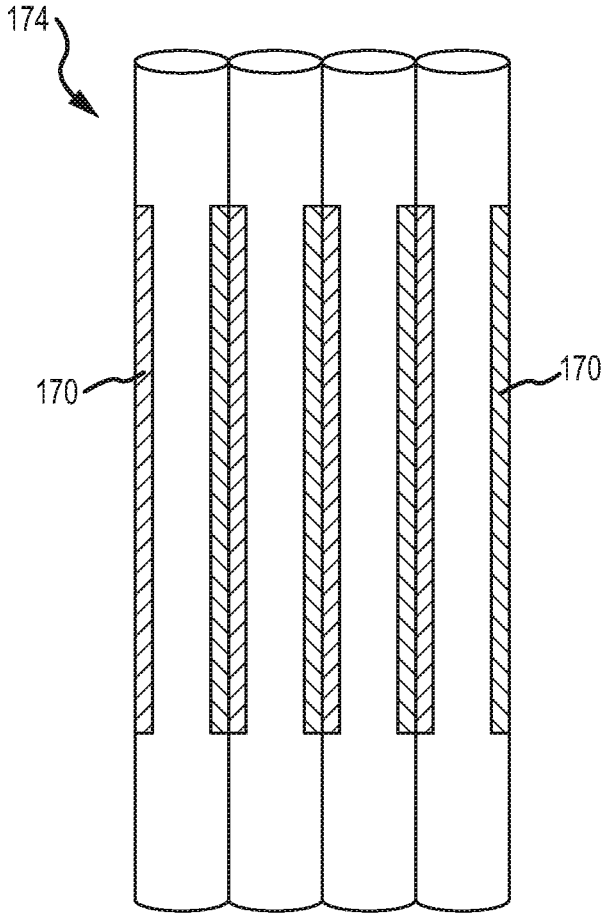
FIG. 13 depicts multiple cords having coded magnetic structures, magnetically locked to one another to form a strip.

However, other cords having the same coded magnetic structures may be attracted to one another. Given proper placement of the patterns on the cords, the cords may join together to form a bundle or strip as shown in FIG. 13. This, in turn, reduces clutter as well as the likelihood that the cords knot or kink around one another. Cords may be rotated or slid to disengage from one another. In certain embodiments, the magnetic coding of each pattern may be such that rotating, sliding and/or otherwise moving one cord with respect to another may cause the cords to repulse one another instead of attract.

In some embodiments, the coded magnetic structures may employ electromagnetic maxels. Thus, in a default unpowered state, the coded structures exert no magnetic field at all. When a current is provided to the maxels, the coded structures become magnetically active and may attract nearby cords, ports and the like as described above. In this manner, the interaction of the cord may be selectively controlled.

It should be appreciated that variants on the above may be used to implement a self-winding or self-coiling cord or cable. For example, a first coded magnet may be provided at a first end or on a first surface of a cable, a second coded magnet at a second end or second surface, and so on. The first and second coded magnets may attract one another and may be complementary in certain embodiments, as may other pairs of coded magnets on the cable surface. When the coded magnets are electromagnetically switched from a default state, they may attract the corresponding coded magnet (e.g., first to second coded magnet and the like) in order to wind, coil or otherwise structure the cable. The cable may remain magnetically locked in this configuration until the coded magnets are again electromagnetically switched, at which point they may be inert or even repel one another. Alternately, mechanically shifting the positions of the coded magnets with respect to one another may cause them to disengage as previously described. It should be noted that the "default" state of the coded magnets described herein may be a state either where current is or is not applied to the individual maxels.

Input Devices

Figure 14:
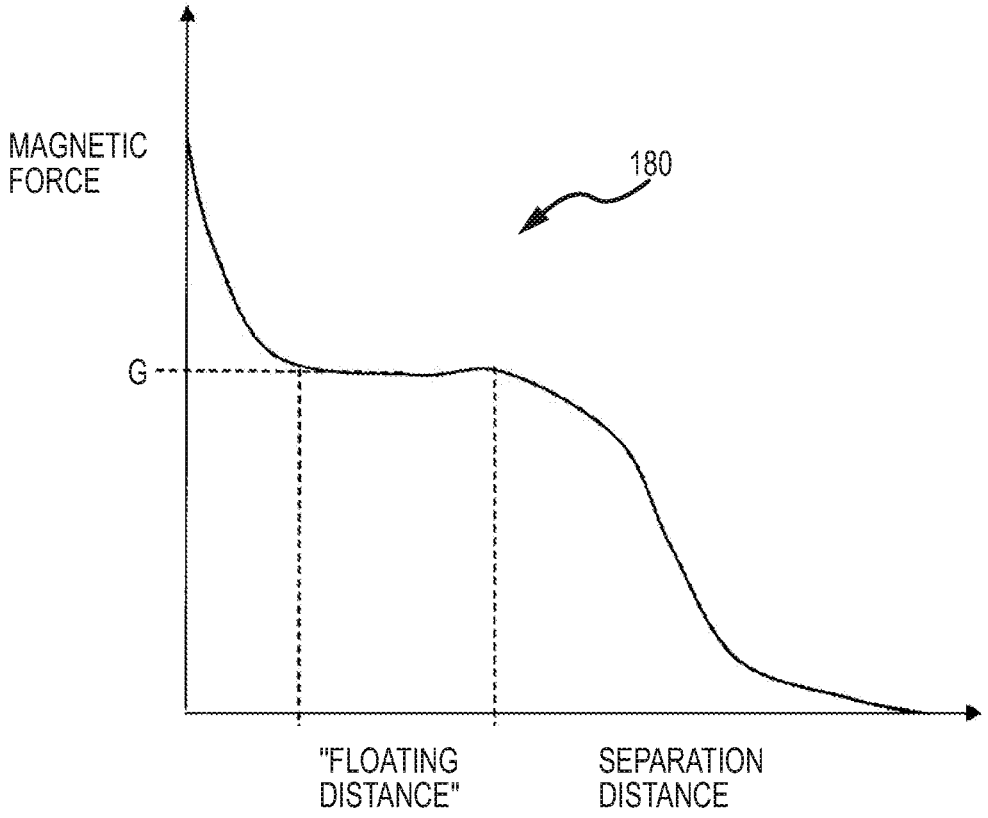
FIG. 14 depicts a sample force curve of a coded magnetic structure used to stably levitate a keycap, in accordance with another embodiment.

A variety of different input devices may be enhanced through the use of coded magnetic surfaces. For example, individual keys of a keyboard may be backed with a coded magnetic structure. Likewise, the surface of the keyboard below each key may have a coded magnetic structure formed thereon that, in conjunction with the coded magnet of the keycap, provides a particular force curve 180 as illustrated in FIG. 14. In alternative embodiments, only one of the keycap and keyboard may utilize a coded magnet while the other is a planar magnet or ferrous material.

At certain points along the force curve of FIG. 14, the magnetic repulsive force will equal the force of gravity G acting on a keycap. That is, at some separation distance between the keycap and keyboard, the repulsive magnetic force will balance out the force of gravity on the keycap. This is shown by the dashed line labeled "G" on FIG. 14. For the range of distances over which the magnetic repulsive force equals G, the keycap will essentially float above the keyboard surface. Properly coded magnetic structures should be sufficient to establish a range of distances over which the magnetic and gravity forces are equal, rather than a single distance. This range of equilibrium distances is labeled "floating distance range" on the graph. If the separation distance between the keycap and keyboard increases, the force due to gravity G overwhelms the magnetic force and the key drops back to the equilibrium distance. Conversely, if a user presses down on the keycap, the magnetic force increases.

This increase in magnetic force, if sufficiently sharp, may be perceived by a user as resistance. The force curve 180 of FIG. 14 can be tailored by properly coding the maxels of the correlated magnetic surface to provide any "feel" desired when the keycap is pressed. For example, if the magnetic repulsive force curve ramps up slowly as separation distance decreases, the floating keycap would feel soft when pressed. Conversely, if the force curve ramps up steeply, the keycap may feel firm. In this manner, the exact haptic feedback experienced by a user interacting with a so-called "floating keycap" may vary in accordance with a designer's or engineer's wishes. In some embodiments, the repulsive force will become sufficiently strong that it resists any casual press or impact on the keyboard at a certain separation distance. When the keycap is released, it will settle back within the floating distance range as the magnetic force repulses the keycap.

A magnetic sensor on the keyboard may detect the increased magnetic flux caused by the keycap approaching the keyboard surface. If the magnetic flux (e.g., magnetic field strength) exceeds a certain threshold, then the keyboard may accept the keycap motion as an input. In this manner, the keyboard may function as normal but be provided with magnetically levitated keys.

It should be appreciated that the foregoing principles may be applied to mice, trackballs, and other input mechanisms as well. Similarly, a magnetic scroll wheel may be incorporated into a mouse such that a sensor measures changes in a magnetic field as the wheel rotates. The scroll wheel may be provided with a ring-shaped coded magnet to facilitate detection of a changing magnetic field; this detection may be used as an input to a corresponding device to indicate the motion of the wheel. Further, since the mouse wheel is magnetically sensed, the mechanical and optical influence of dirt or debris in or near the wheel is irrelevant, presuming the dirt or debris is not metallic or magnetic in nature. Unlike an optical or mechanical sensor that may get jammed with dirt or dust and thus not detect the wheel's motion, dirt/dust has no mechanical or optical effect on sensing changes in a magnetic field caused by rotating a wheel having a properly coded magnetic surface thereon.

In addition, the levitating properties of properly configured correlated magnetic surfaces may be used to align electronic devices with respect to inductive chargers. By adjusting not only a separation distance (e.g., z-axis) but also moving the electronic device toward the optimal inductive charging position within a plane, enhanced charging may be achieved.

Correlated magnetic surfaces may be used to rotate and/or laterally move the electronic device relatively easily once it is suspended in midair in the fashion described herein. A series of correlated magnets may cooperate to define a "wall" of repulsive force to hem the device within a particular area, or guide it to the area. Similar techniques may be used to lock a device to a dock for charging, or to align a device with a dock for optical data transmission (for example, in the case of an optical dock).

In a similar fashion, a mouse or other chargeable device may be pushed and/or pulled back to its docking station through the application of coded magnetic surfaces. These coded magnetic surfaces may only activate when the mouse battery falls below a certain level, or when the mouse does not move for a certain time. Battery charge may be monitored by the mouse and relayed to a microprocessor operative to supply voltage to the surfaces' electromagnetic maxels, thus initiating the motion of the mouse towards its charger. Similarly, an associated computing device may determine when the mouse is stationary for a threshold time and activate the electromagnetic maxels once that time is exceeded to push/pull the mouse to the charging station.

Figure 15:
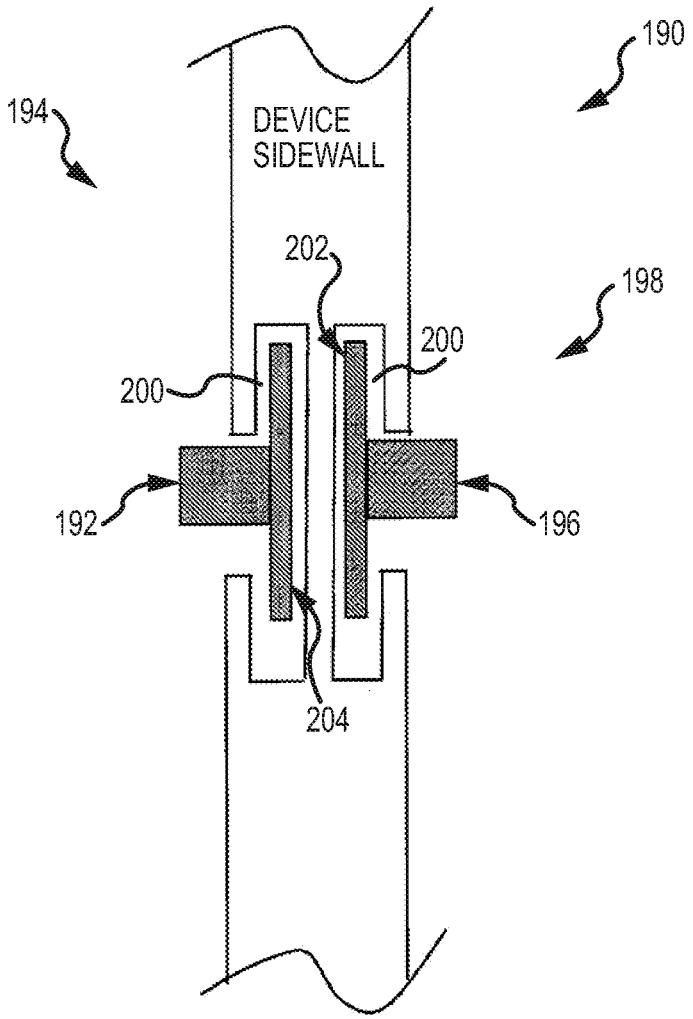
FIG. 15 depicts still another embodiment in the shape of magnetically mated switches.

FIG. 15 depicts a cross-sectional, schematic side view of a waterproof and/or air-tight switch 190 employing magnetic surfaces. Such switches may be useful for devices where water and/or gases should be kept out of the device interior, including computers, portable computing devices, mobile phones, portable music players, network switches, routers and the like, refrigerators and other household appliances, televisions, and so on.

As shown in the figure, an interior switch 192 is located within the internal side 194 of the device and an exterior switch 196 is located on the external device side 198, approximately across from each other and separated by a portion of the device's wall. Each switch may be partially within a cavity 200 formed to restrict motion of the switch, as is known in the art. Alternative methods of ensuring the switch moves only in the manner desired are also contemplated by this document and in alternative embodiments.

The exterior switch 196 includes a coded magnetic surface 202 on its inward-facing portion (e.g., the portion facing the interior switch). Likewise, the interior switch 192 includes a coded magnetic surface 204 on its outward facing surface (e.g., the portion facing the exterior switch). The exterior and interior coded magnetic surfaces may be programmed to resist translational decoupling from one another. Accordingly, as a user drags or moves the exterior switch from a first to a second position, the coded magnetic surfaces cooperate to slide the interior switch in the same direction. Essentially, the exterior and interior switches 192, 196 are magnetically coupled such that motion of one moves the other. In this manner, the interior switch may trigger device functionality even though it is never moved or touched by a user. Since the magnetic coupling forces between switches extend through the sidewall, the interior switch 192 and internal portion of the device may be waterproof and/or hermetically sealed.

In an alternative embodiment, the interior switch may be replaced by a sensor that reads the motion of the maxels on the exterior switch and controls operation of a device accordingly. Thus, as the exterior switch slides, the interior sensor detects the motion and instructs the device to activate, deactivate or provide other functionality (such as controlling audio volume), as appropriate. In this manner, the switch may have no moving internal parts at all. Further, appropriately configuring the external coded magnet may permit the internal switch to detect both the type and distance of any movement.

Other input devices may also be created through the application of coded magnetics. For example, and similar to the embodiment shown in FIG. 15, an external button and internal button may have opposing coded magnetic surfaces. In this case, the surfaces may be repulsive rather than attractive. A spring or other resistive element may bias the internal button forward against the device sidewall; a second spring or resistive element may bias the external button outward.

As a user pushes the external button against the spring, the repulsive magnetic force may likewise push the internal button downward, into the device exterior. After traveling a sufficient distance, the internal button may close a contact, open a contact, or otherwise initiate or terminate some device functionality. A detent or locking mechanism may hold the exterior button in place until a user depresses it or otherwise interacts with the button. The repulsive magnetic force may be sufficient to hold the interior button in place when the external button is stationary. As the external button is depressed, the interior button may rise and terminate device functionality.

It should be appreciated that the programmable force curve that may be achieved with correlated magnets make such a button arrangement feasible, as the force curve may be simultaneously programmed to attract the internal and external buttons to one another when they have too great a separation distance but repulse the buttons from one another when the separation distance grows too small.

Bearings and Motors

Correlated magnets, and the programmable force curves associated with them in particular, may also be used to tune bearings and motors within an electronic device, machinery or other system. If the maxels are electromagnetic, the correlated magnet may provide dynamic tuning capabilities. Certain examples follow.

In mechanically and electrically complex systems, such as a laptop computer or other portable computing device, different system components can interfere with each others' operation. As one example, a moving element such as a fan near another element, like a hard drive, may create a harmonic frequency that disrupts the drive's operation. This is but a single example for purposes of illustration. If feedback from the hard drive (or other element) indicates excessive motion then the fan may be damped by means of an associated, dynamically programmed correlated magnet. The correlated magnet may, for example, repulse the fan or a portion of the fan to change its motion and thus the generated interference. The magnet may likewise attract the fan or a portion thereof. For purposes of attraction and repulsion, certain embodiments may place a second, appropriately coded correlated magnet on a portion of the fan. Further, by dynamically adjusting the polarity of individual maxels, the attractive or repulsive strength of the correlated magnet(s) may be changed on the fly to provide customized damping.

Feedback regarding the hard drive's motion may be gathered from any appropriate sensor, such as a gyroscope or accelerometer. It should be appreciated that the fan and hard drive are used solely to illustrate the principle of dynamic system damping using programmable correlated magnets, and particularly programmable correlated magnets with electromagnetic maxels.

Coded magnets may also be used in a brushless DC motor in order to increase control of angular momentum. Coded magnets may be used, for example, to provide position control to a motor (via the adjustable force curve) without requiring a separate angle encoder for the motor.

Still another example of this will be provided with respect to fans inside a computer case. During shipping, installation and/or assembly, fans may be damaged or pushed off-center such that their rotation becomes erratic and noisy. A programmable correlated magnet may be used to "push" or "pull" the fan back into alignment. Fans may be provided with magnetic bearings to facilitate this operation.

As still another example, coded magnets may be used to buffer a hard drive from a sudden, sharp drop or fall. An accelerometer may detect abrupt motion of the hard drive in a specific direction. If this motion exceeds a threshold, a coded magnet may be activated to push the hard drive away from its enclosure. Given a sufficiently strong repulsive force, the hard drive may be prevented from impacting the enclosure or anything else, thereby reducing the likelihood of damage to data resulting from a dropped or falling laptop.

Further, coded magnets may be used to change the acoustic properties of fans operating in a computer housing, or the acoustic properties of any motorized device. An appropriately coded magnet may intermittently adjust the rotational speed of a fan, thereby preventing the fan from emitting a beat frequency. Further, the coded magnet may adjust the fan speed in such a manner that the fan produces white noise or a noise masking the operation of other components. A microphone may be used as a sensor to determine the fan noise or noise of another component. A microprocessor may use the microphone's output to dynamically adjust the polarity of the coded magnet's maxels to impact the fan's operation as described above.

Assembly of Devices

It should be appreciated that the precise alignment and "homing" that may be achieved with appropriately configured pairs of correlated magnetic surfaces may provide useful functionality for precision assembly of devices. As one example, a laptop computer generally has precise tolerances and positions for all its constituent elements within the laptop chassis. If one element is misplaced, the laptop may not function properly or may not pass a final assembly inspection.

Continuing this example, each element to be placed within a laptop computer may have a coded magnetic surface with a unique magnetic code. A certain position within the laptop chassis may have the complementary or attracting coded magnetic surface. Thus, when the element is near that position, it may self-align at the position. Further, such alignment is not necessarily limited to lateral motion but may include rotational alignment as well. This precision alignment may facilitate construction or assembly of fault-intolerant devices.

Another embodiment may take the form of an assembly tool with a coded magnetic surface that dynamically changes as assembly of a device proceeds, such that the tool mates with the next element to be placed in the assembly process. For a simplified example, consider a screwdriver sized to accept multiple screws of different lengths, head sizes and the like. As assembly of a device proceeds, the screwdriver may receive a command from a computing device overseeing the assembly process to dynamically change the coding of a correlated magnet on the screwdriver tip. An operator may lower the screwdriver into a container of screws and attract to the tool only the screw that has an attractive coded magnetic surface. Thus, the screwdriver may attract only the proper screw for the next assembly step.

This same concept may be applied to automated assembly lines. Essentially, if the assembly tool (such as a robotic arm) can receive feedback regarding the current state of the assembly process, it may dynamically reprogram its correlated magnetic surface to pick up the next piece for placement and put it in the proper area, according to the foregoing disclosure.

Certain embodiments may take the form of a magnetic "rivet" or fastener. The rivet may include multiple splines that are magnetically locked to the rivet body in a withdrawn position. When the rivet is inserted into or through a material, the insertion tool may dynamically deactivate the electromagnetic magnets holding the splines to the body. The splines may thus extend outward behind the material in a fashion similar to an anchor bolt. In alternative embodiments, the tool used to place the rivet may have a coded magnetic surface that attracts the splines to the tool, thereby keeping them flush against the barrel. When the tool is removed, the splines extend. In this embodiment, the magnetic rivet may have a bore into which the tool may fit in order to draw the splines inward against the rivet body.

In addition to assembling devices through the use of coded magnetic surfaces, devices held together by such surfaces may be relatively easily disassembled. Degaussing the device may wipe the coded magnetic surfaces, causing them to no longer attract one another. Thus, at least certain portion of the device may easily separate from one another for breakdown, recycling and the like.

Data Encoding

General concepts of encoded, matching elements facilitated by coded magnetic surfaces were discussed above in the section labeled "Cables." The concepts set forth therein, including dynamic matching of two devices and dynamic reprogramming of one or more coded magnets may be applied to a wide variety of electronic devices.

Still another example of data encoding that may be accomplished through coded magnets with electromagnetic maxels is a "challenge and reply" authentication scheme. For example, a key may be inserted into a lock, a cable into a port, or two devices may sit side by side. In any of the foregoing, both the key and lock/cable and port/first and second device may have a coded magnet surface adjacent one another. One of these two coded magnetic surfaces may be controlled by a microprocessor to rapidly change the polarity of certain maxels in a specific pattern. The other coded magnetic surface may be programmed to change its' maxels' polarity to generate the complement of the first surface's changing pattern. Thus, as both coded magnetic surfaces change with time, they remain magnetically attracted to one another and their corresponding elements coupled to one another. Should either coded magnetic surface fail to change according to the determined pattern, the associated elements may be magnetically repulsed from one another. This may have consequences ranging from ejecting cable from a port, to moving a key out of a lock, to terminating data communication between two computing devices.

In another embodiment, a key may have a coded magnetic surface. The key may be inserted into a lock. Instead of mechanically moving tumblers within the lock, the key may attract or repulse tumblers via the coded magnetic surface. Accordingly, only a key with the proper coded magnetic surface may move the tumblers into the proper position to open the lock. Both polarity and intensity of any given may facilitate moving a tumbler into the proper position. In such embodiments, it should be noted that both the key surface and the lock may be smooth, since mechanical interaction between the key and tumblers is not required. Further, the tumblers may be placed behind a sidewall made from plastic or another material that does not interfere with magnetic fields, thus reducing the likelihood that the lock may be picked.

Similar principles may be used to identify two devices to one another through dynamically programmable coded magnets. The changes in the coded magnet's field may correspond to an identification sequence for a particular device. Further, devices equipped with magnetic sensors may detect other devices with coded magnetic surfaces. The magnetic surface may be coded to act as a device identifier when static; the resulting magnetic field may be unique and detectable by nearby devices. Thus, a device sufficiently near another device to detect the magnetic fields of the adjacent device's coded magnetic surface may read this data as a serial number or other identifier for the adjacent device.

Yet another embodiment may employ matching coded magnetic surfaces to transmit data. The electromagnetic maxels may vary their polarities to transmit data to a magnetically sensitive sensor. Essentially, since the maxels may be programmed and are binary in nature (e.g., either showing a north or south pole, depending on current), each maxel may transmit binary sequences to an appropriately-configured sensor. Likewise, multiple maxels adjacent one another may cooperate to transmit longer binary codes simultaneously. If the maxels of a correlated magnetic surface are used for such a purpose, it may be desirable to have fixed magnets with a higher magnetic flux than that of the maxels to ensure the cable stays mated to the port (or the two devices to one another, and so forth). A mechanical mating may be used in certain embodiments.

Latches

Certain embodiments may also take the form of a latch or closing mechanism for an electronic device, box or other item that may be opened and closed. One example of such a device is a laptop computer. A first correlated magnet may be placed at a lip or edge of a device enclosure, typically in a position abutting the top or lid of the device when the device is in a closed position. A second magnet may be located in the lid and generally adjacent the first correlated magnet when the device is closed. The first and second correlated magnets may be coded to attract one another when the separation distance is below a threshold and repulse one another when the separation distance exceeds the threshold. Thus, the correlated magnets may assist in opening or closing the device, depending on the separation distance. The magnets may have sufficient attractive force below the separation threshold to automatically pull the device closed in certain embodiments.

Another embodiment may place multiple coded magnets in the clutch (e.g., hinge) of a laptop computer or similar device. One coded magnet may be in the portion of the clutch engaged with the base of the laptop and one on the clutch portion engaged with the top of the laptop. The magnets may be coded to rotationally repulse one another until a certain rotational alignment is achieved, at which point the magnets may be coded to attract one another. In this fashion, the circular coded magnets may act as a detent to hold the device top open in a particular position with respect to the device base. The coded magnets may have multiple such virtual detents to permit a user a range of options for opening and/or closing the device.

Ferrofluids

Various embodiments may employ coded magnets with ferrofluids to achieve a variety of effects. Ferrofluids are generally liquids that become strongly polarized in the presence of a magnetic field. Ferrofluids may thus be attracted and repulsed by magnetic fields.

Certain embodiments may employ coded magnets to attract or repulse ferrofluids to place ferrofluids in a particular place at a particular time. As one example, a coded magnet may be activated when a proximity sensor detects a finger approaching a touchpad or other surface capable of detecting a touch. (The exact mechanics of how the surface detects the touch are irrelevant; the present disclosure is intended to encompass capacitive sensing, IR sensing, resistive sensing and so on.) As the finger (or other object) approaches the surface, the proximity sensor's output may activate a coded magnet beneath the portion of the surface about to be impacted. This coded magnet may draw ferrofluid to it, resulting in an upper portion of the surface rising or bulging. In this manner, the touch-sensitive surface may provide visual and/or haptic feedback indicating the touch has been sensed. Haptic feedback may be achieved because the feel of touching the ferrofluid-filled bulge would be different than touching the flat touch-sensitive surface. Further, it should be appreciated that the sensing algorithms and/or capabilities of the surface may be adjusted to account for the pool of ferrofluid.

Yet another embodiment may apply the foregoing principles to a touch-sensitive keyboard with a flat surface. Keys may be inflated by attracting ferrofluid to the appropriate key just before or as the key is touched. In such an embodiment, a maxel may be located beneath each key with the maxels beneath all keys (and, possibly, other areas of the keyboard) forming the coded magnet. It should be appreciated that the coded magnet underlying the keyboard may be dynamically programmed to direct ferrofluid where necessary and repulse ferrofluid from other areas. Thus, upon sensing an imminent touch, the polarities of more maxels than merely the one underlying the key to be touched may change. As one example, the maxels may change polarities in order to drive ferrofluid beneath the key in question, then changed again to drive ferrofluid out from beneath any key other than the one about to be touched.

Insofar as ferrofluids are generally opaque, certain embodiments may employ coded magnets to attract or repulse ferrofluids beneath or within an input or output device to alter the translucence of the device. For example, a certain amount of ferrofluid may be drawn beneath a transparent surface with a backlight. The ferrofluid may be repulsed from a particular point beneath that surface but maintained in all other areas, thereby creating a lighter point on the surface to indicate where a user should touch or interact with the device.

Yet another embodiment may employ correlated magnets and a ferrofluid as elements of a cooling system. Liquid cooling systems are commonly employed in electronic devices to remove heat from certain elements, such as processors. Ferrofluids are used in certain thermal cooling systems; as a ferrofluid is heated, its magnetic qualities decrease (e.g., it becomes less attracted to a magnet). Thus, a magnet near an element to be cooled will attract ferrofluid which will be heated by the element, thereby becoming less magnetically sensitive. The heated ferrofluid will flow away from the magnet and be replaced by cool ferrofluid. This cycle may continue indefinitely.

By using a dynamically programmable correlated magnet (e.g., one with electromagnetic maxels), the magnetic attraction and/or repulsion of ferrofluid to hot spots or elements within an electronic device may be enhanced. Thus, as certain areas or element heat up, more ferrofluid may be diverted to that area to enhance cooling.

Other Embodiments

Various other embodiments may use correlated magnets to achieve a variety of effects and implement certain features. As one example, an electronic device (e.g., a laptop, audio/video receiver, other computer, portable computing device, television, monitor and the like) may employ correlated magnets to provide active valving for thermal management. Many electronic devices have dedicated airflow paths to move air masses to and/or through particular areas for cooling. Typically, these paths are static and passive—they direct however much airflow is provided to them and cannot change the flow paths.

In one embodiment, coded magnets may be used to open or close louvers in the airflow paths, thus shutting off and/or redirecting air within the electronic device enclosure. The coded magnets may be electromagnetically programmed to open and/or close louvers as necessary to route air from a fan to a particular portion of the device enclosure. For example, the outputs of various thermal sensors may be used to determine where more airflow is necessary to cool a hot internal element or area, and the coded magnets may be reprogrammed on the fly to attract and/or repulse the louvers to direct the airflow accordingly. In some embodiments, the airflow ducts, louvers and magnets may be formed in a separate layer so that the louvers may move freely without impacting other internal components.

As still another option, the foregoing may be applied to magnetically lower louvers across exhaust and/or air intake ports when no or minimal cooling is needed. Likewise, the louvers may be magnetically raised by the electromagnetic coded magnets when air intake and/or exhaust is desired. Further, because the coded magnets may be electromagnetically reprogrammed in real-time, the distance to which the louvers open (and thus the amount of air let in or exhausted) may likewise be controlled.

Still another embodiment may employ correlated magnets to cool electronic components within an enclosure via the magnetocaloric effect. The coded magnet may control this effect and/or act as a heat pump to shift heat through the enclosure as necessary. The magnetocaloric effect generally employs a changing magnetic field in certain alloys to decrease the surface temperature of that alloy, as known in the art.

Still another embodiment may employ correlated magnets to track the motion of a stylus on a screen, trackpad or other surface. The stylus may have a magnetic sensor located thereon that may detect the unique magnetic fields produced by coded magnets. By placing a number of coded magnets beneath the surface, the stylus may read the unique magnetic field of each coded magnet and thereby know its relative position on the surface. The stylus may relay this information to an associated electronic device to permit the device to know the stylus' location. Such information may be transmitted wirelessly or over a wired connection.

Alternately, the surface may have a number of magnetic sensors located beneath it and the stylus may have a unique magnetic signature generated by a coded magnet located on the stylus (for example, at the tip of the stylus). The magnetic sensors may thus track the motion of the stylus and sense its location relative to the surface.

Coded magnets may also be used as speaker actuators and provide additional speaker control. For example, if the speaker actuator is a coded magnet, it may also function as a sensor to determine the position of the speaker driver. This data may be used as part of a feedback control loop to improve accuracy of the driver.

Yet another embodiment may incorporate correlated magnets to detect when a lithium-ion polymer battery swells. As these types of batteries age and are used, they may thicken and/or warp. In electronic device enclosures with strict tolerances, this may lead to a risk of fire if the internals of the battery are punctured due to battery motion, thickening, warping and so on. A correlated magnet pair (one on the battery and one nearby) may be used to sense the position of the battery. The correlated magnet not on the battery may detect a change in the magnetic field strength and/or polarity as the battery swells and the correlated magnet thereon moves accordingly. If this change is sensed, the electronic device may disable the battery. As yet another option, as the field strength of the correlated magnet increases, it may flip a magnetic switch that disables the battery.

Generally, embodiments discussed herein have presumed that the maxel array of the coded magnet has the maxels positioned at uniform distances from one another, or adjacent to one another. It should be appreciated that the force curve of a coded magnet may be adjusted by changing the spacing of individual maxels as well as changing the polarity and/or magnetic strength of the maxels. Certain embodiments may even employ maxels that may be shifted in one or more dimensions to dynamically adjust the aforementioned force curve to achieve a variety of effects, including those listed herein.

Electronic devices may employ correlated magnets to enable and disable power buttons. Many users accidentally press the power buttons of their electronic devices when using them, which may lead to a loss of data or interruption of use when the device is on. This may be avoided through the use of at least one correlated magnet.

As an example, presume an electromagnetic correlated magnet is located beneath a metal or magnetic power button. The correlated magnet may be off until the device is turned on via the button, at which point the electromagnetic maxels of the correlated magnet are activated. At this point, the correlated magnet may repulse the power button and thus prevent it from being pushed in, which in turn prevents the user from accidentally powering down the device. The correlated magnet may stay powered on until a certain condition is met. One example of such a condition is that the user ceases to interact with the device in any fashion for a minimum time. Another is that the device fails to provide any output for a minimum time.

Regardless, once the condition is met, the correlated magnet may be depowered, thereby permitting the user to depress the power button and turn off the device.

Magnetic ID Tags

Certain embodiments may employ coded magnets as identification tags. Devices with appropriately configured magnetic sensors (and/or coded magnets of their own, which may function as magnetic sensors) may detect the magnetic field of a nearby coded magnet. This magnetic field may act as a "signature" to identify the coded magnet and an object associated with it. Thus, the coded magnet may function as a sort of close-proximity identification chip, but without requiring any active broadcast or mechanical connection.

As one example, a museum may include multiple coded magnets at or near each exhibit; each coded magnet may generate a unique magnetic field. As a visitor approaches the exhibit, the user's electronic device may detect the magnetic field and compare it to a master database downloaded onto the device upon entering the museum. The device may match the magnetic field to an entry in the database and retrieve information from the database associated with the field. The electronic device may display this information to the visitor, thus allowing him or her to appreciate the exhibit without requiring him or her to dock the device to a connector or receive any broadcast. This process may be applied in other venues, as well.

Keys and access cards may likewise incorporate coded magnets to permit or deny entry. A user's access card may have a unique magnetic signature that may be recognized by a card reader, which may allow or deny entry based on that signature.

Although this document lists several concepts, methods, systems and apparatuses using correlated magnets, it should be appreciated by those of ordinary skill in the art that the contents of this document may be readily adapted to various other embodiments without requiring any inventive step. Accordingly, the concepts, methods, systems, apparatuses and the like discussed herein are provided by way of illustration and not limitation.

We claim:

1. A connector, comprising:

a first coded magnet on a first surface of a first device, the first coded magnet having at least two different polarity regions on the first surface, wherein the first coded magnet comprises at least one electromagnet and a dynamically programmable force curve of the first coded magnet is changed by applying electricity to the electromagnet; and a second coded magnet on a second surface of a second device; wherein the second coded magnet is configured to provide identifying information regarding the device on which it is located, and wherein the first device comprises a controller in communication with the first coded magnet and the controller is configured to read the arrangement of the first coded magnet and identify the second device.

2. The device of claim 1, wherein the second coded magnet is dynamic and is configured to arrange itself to compliment the first coded magnet so that the device of the second coded magnet is identifiable by the device of first coded magnet.

3. The device of claim 1, wherein the first surface is a portion of a cable.

4. The device of claim 1, wherein the first device comprises one or more configurable conductors.

5. The device of claim 4, wherein the one or more configurable conductors comprises one or more pins configured to extend or retract from the first device based on a determination of the identity of the second device.

6. The device of claim 4, wherein the one or more configurable conductors remain obscured by the first device until the first device identifies the second device.

7. The device of claim 1, wherein the first magnet is configurable to repulse the second magnet to decouple the first and second devices.

8. The device of claim 1, wherein the first magnet is configurable to prevent coupling of the first and second device.

9. The device of claim 1, wherein the second surface comprises a surface of a port of an electronic device.

10. The device of claim 9, wherein:

the second coded magnet comprises at least one electromagnet; and a dynamically programmable force curve of the second coded magnet is changed by applying electricity to the electromagnet.

11. The device of claim 10, wherein the second device comprises one or more configurable conductors configured to extend or retract within the port of the second device based on a determination of the identity of the first device.

12. The device claim 10, wherein:

the second coded magnet is configured to identify the first coded magnet; and the port is configurable to receive the device of the first coded magnet.

* * * * *